US005210720A

United States Patent [19]

Caprette, Jr. et al.

[11] Patent Number: 5,210,720

[45] Date of Patent: May 11, 1993

[54] COMPLIANT TUBE BAFFLE

[75] Inventors: Samuel J. Caprette, Jr., Chagrin Falls; Lawrence J. Howard, Jr., Uniontown, both of Ohio; Bernie Fink, Laguna Hills, Calif.

[73] Assignee: The B. F. Goodrich Company, Akron, Ohio

[21] Appl. No.: 383,679

[22] Filed: Jul. 24, 1989

Related U.S. Application Data

[63] Continuation of Ser. No. 51,799, May 20, 1987, abandoned.

[51] Int. Cl.[5] ..... H04R 1/44

[52] U.S. Cl. ..... 367/176

[58] Field of Search ..... 367/1, 141, 149, 151, 367/153, 154, 162, 163, 165, 173, 174, 176, 188, 901, 191; 181/0.5, 175, 198, 233, 286, 288, 282

[56] References Cited

U.S. PATENT DOCUMENTS

| | | | |
|---|---|---|---|
| 2,811,216 | 10/1957 | Harris | 367/1 |
| 2,906,993 | 9/1959 | Steinberger | 340/10 |
| 3,021,504 | 2/1962 | Toulis | 367/157 |
| 3,500,305 | 3/1970 | Vincent | 367/1 |
| 3,647,022 | 3/1972 | Meyer et al. | 367/1 |
| 3,907,062 | 9/1975 | Brigham et al. | 367/176 |
| 4,184,093 | 1/1980 | Sullivan | 310/800 |
| 4,399,526 | 8/1985 | Eynck | 367/149 |
| 4,450,544 | 5/1984 | Denaro et al. | 367/176 |
| 4,669,573 | 6/1987 | Goodman | 181/175 |
| 4,709,361 | 11/1987 | Dahlstrom et al. | 367/165 |
| 4,759,000 | 7/1988 | Reitz | 367/176 |
| 4,815,050 | 3/1989 | Kurz | 367/176 |
| 4,887,247 | 12/1989 | Black et al. | 367/151 |

FOREIGN PATENT DOCUMENTS 2536195 5/1984 France .

OTHER PUBLICATIONS

Water-borne sound insertion loss of a planar compliant-tube array Junger, 1985, pp. 1011-1012, J. Acoustical Assoc.

*Primary Examiner*—Charles T. Jordan

*Attorney, Agent, or Firm*—Woodrow W. Ban; David M. Ronyak

[57] ABSTRACT

A compliant baffle for use in a marine environment wherein a pair of plate-like elements are separated in a spaced predetermined manner typically employing T-blocks, rods, or edges of the plate-like elements bent one towards the next, surrounded by an elastomeric encapsulant and configured into ranks of box-like structures forming a sonic reflector or baffle. The baffle finds utility in reflecting noise in especially at great depths in marine environments.

23 Claims, 2 Drawing Sheets

COMPLIANT TUBE BAFFLE

This is a continuation of application Ser. No. 07/051,799, filed May 20, 1987, now abandoned.

FIELD OF THE INVENTION

This invention relates to sonic reflectors or barriers configured for use in a marine environment, more particularly to sonic reflectors adapted for use in a marine environment at depths characterizing the operation of deep water submersibles, and most particularly those sonic reflectors configured for operation in a deep water environment in connection with sonic arrays.

BACKGROUND OF THE INVENTION

Sonic reflectors are known in the art. Historically sonic reflectors have been divided into generally two basic categories: one group being so-called low-pressure reflectors finding utility in marine environments of modest depth; the other group being configured for operation at greater depths.

With respect to the former group, such baffles are often formed from rubber having air-filled cells therein or, alternately, thick sheets of rubber covered metal. For deep water marine environments, sheets of rubber having air-filled cavities therein tend to lose effectiveness, at least in part because of elevated hydrostatic pressures encountered and in part due to long immersion. Thick rubber covered plates in such deep water environments may be difficult to tune and through sheer bulkiness can provoke operational difficulties particularly where it is desired that low frequencies be reflected.

One high pressure baffle configuration finding acceptance in a deep water environment is a so-called squashed-tube configuration. Squashed-tube baffles are shown and described, for example, in U.S. Pat. No. 3,021,504 (Toulis). Squashed-tubes are typically formed by compressing a metallic tube into a permanently deformed ovaloid configuration. Such deformed tubes may then be grouped in bundles oriented to have longitudinal axes thereof generally parallelly coplanar, or otherwise oriented to define a curvilinear surface formed of the generally parallelly oriented squashed-tubes.

In addition, it has been determined that such squashed-tubes may be oriented in ranks, squashed-tubes within a particular rank being generally parallelly oriented, and the ranks may be applied to the surface of vessels such as submarines in order to shield sonic arrays mounted thereover from sonic interference emanating from within the vessel.

It is known that such squashed-tubes may be encapsulated in rubber. Encapsulation can assist in assuring against water infiltration into the squashed-tube with consequent, attendant, disruption of reflecting or baffling capability. Depending upon the nature and construction of the rubber encapsulant, encapsulation can assist in enhancing reflection or baffling characteristics associated with a squashed-tube array.

Frequently in applying squashed-tube baffle arrays to an external surface of a vessel, it may be desirable to utilize more than a single rank of such squashed-tubes with each rank being a series of squashed-tubes arranged to define a sheet-like formation in a plane generally Parallel to an external surface of the vessel, squashed-tubes in each rank being of a different physical size. This difference in physical size of the tubes forming each rank assists in baffling or reflecting different sonic frequencies. Both the width of individual tubes between different arrays may vary, and the thickness of metal walls defining the tubes may vary from rank to rank to enhance a capability for the array handling a variety of sonic frequencies.

In deep water marine environments, the squashed-tubes respond to increasing hydrostatic pressure as a submersible embodying an array of such squashed-tubes descend through the depths. In response to increasing hydrostatic pressure the tubes flatten even more at the greater marine depths, but typically maintain a pocket of air therein to continue a reflector or baffling function. At extreme depths, the squashed-tube may flatten to the extent that center portions of the long radius curvilinear surfaces of the ovaloid defined by the tube touch one to the other thereby mechanically supporting the squashed-tube in some measure against additional collapse.

Where the squashed-tubes have been formed from a relatively spring-like or elastic material, that is one tending to return to a physical configuration characterizing the tube prior to hydrostatic compression, the squashed-tubes, with a rise of the submersible from great depths will resume their previously ovaloid configuration.

The manner in which compliant tube arrays formed from squashed-tubes function in reflecting or baffling acoustic frequencies can be described mathematically. While the mathematics of predicting precisely the behavior of a squashed-tube array can be tedious at best, certain approximations are available in the art for predicting the approximate performance of a particular squashed-tube array. One such prediction method is described in an article entitled *Water-Borne Sound Insertion Loss of a Planar Compliant-Tube Array* published in *J. Acoust. Soc. AM.* 78 (3), September 1985 and authored by M. C. Junger.

The Junger prediction is based upon a flat-plate model of an array having flat-plate surfaces associated with tubular members of the array; arrays formed from squashed-tubes, in part because of their ovaloid configuration, do not approach the acoustic performance predicted by a flat plate model as accurately as, perhaps, array formed from essentially flat plate structures may.

Additionally, where squashed-tubes become excessively deformed by exposure to unexpectedly elevated hydrostatic pressures, the squashed-tubes may become to some extent permanently deformed from a naturally ovaloid configuration thereby permanently interfering with a capability for an array of the squashed-tubes to Perform satisfactorily as a baffle or reflector.

A baffle formed of an array of tubular structures having a flat plate general configuration, the behavior which is substantially predictable employing relatively simple prediction models, could find utility in deep water applications. Where such baffles can be formed economically employinq readily available materials, and are less susceptible to crush damage from inadvertent exposure to excessive hydrostatic pressures, the Potential utility is even greater.

SUMMARY OF THE INVENTION

The present invention provides a sonic reflector configured for use in a marine environment. The sonic reflector includes a plurality of hollowed box-like structures each formed of at least two discreet plate-like longitudinal, mechanical, parallelly oriented elements. Each box-like structure is Possessed of a length substantially in excess of the width or thickness thereof. The box-like structures are arranged generally in at least one rank with box-like structures within particular ranks having lengths thereof oriented substantially parallelly. The box-like structures thereby may define a planar-like rank or a curvilinear surface.

At least one elastomeric encapsulant surrounds and encapsulates the individual box-like structures. The elastomeric encapsulant is formed principally of an elastomer imparting to the elastomeric encapsulant ply desired acoustic properties.

The longitudinal mechanical elements are or comprise a pair of plate-like elements configured in a generally parallel plane relationship and spaced one apart from the next to a desired extent. Spacers are provided, unattachedly configured to support and separate the plate-like elements to the desired spaced-apart extent. In preferred embodiments the spacers are configured in the form of T-blocks or curvilinear bearing surfaces with the curvilinear bearing surfaces typically being rods, rod segments, or balls. Where the curvilinear bearing surfaces are rods or balls, typically the parallel plate-like elements include channels formed therein configured to receive the curvilinear bearing surfaces thereby reducing an opportunity for movement of the curvilinear bearing surfaces from a desired position configured to establish the spaced apart relationship between the plate-like elements.

Alternately, in lieu of spacers between the plate-like elements, the plate-like elements may be bent at edges thereof, one towards the next to form a box-like structure. The edges, as bent, unattachedly rest one upon the other to define the box-like structure.

In preferred embodiments, each box-like structure includes end closures unattachedly configured to function as end plates, closing the box-like structures and thereby supporting the elastomeric encapsulant where encapsulating the box-like structures adjacent end portions, the end portions being defined with respect to a longitudinal dimension of the box-like elements defining generally the plate-like ranks.

The reflector of the invention is preferably configured for mounting to an outer surface of the deep water submersible such as a submarine. The reflector is further configured to reflect sonic frequencies emanating from within the submersible and, in preferred environments, thereby protect an acoustic array such as a sonar array positioned on a surface of the reflector obverse to that attached to the submersible from spurious acoustic frequencies emanating from within the submersible.

The above and other features and advantages of the invention will become more apparent when considered in light of a description of a preferred embodiment of the invention together with a drawing comprising four Figures which follow together forming a part of the specification.

BEST EMBODIMENT OF THE INVENTION

Figure 1:
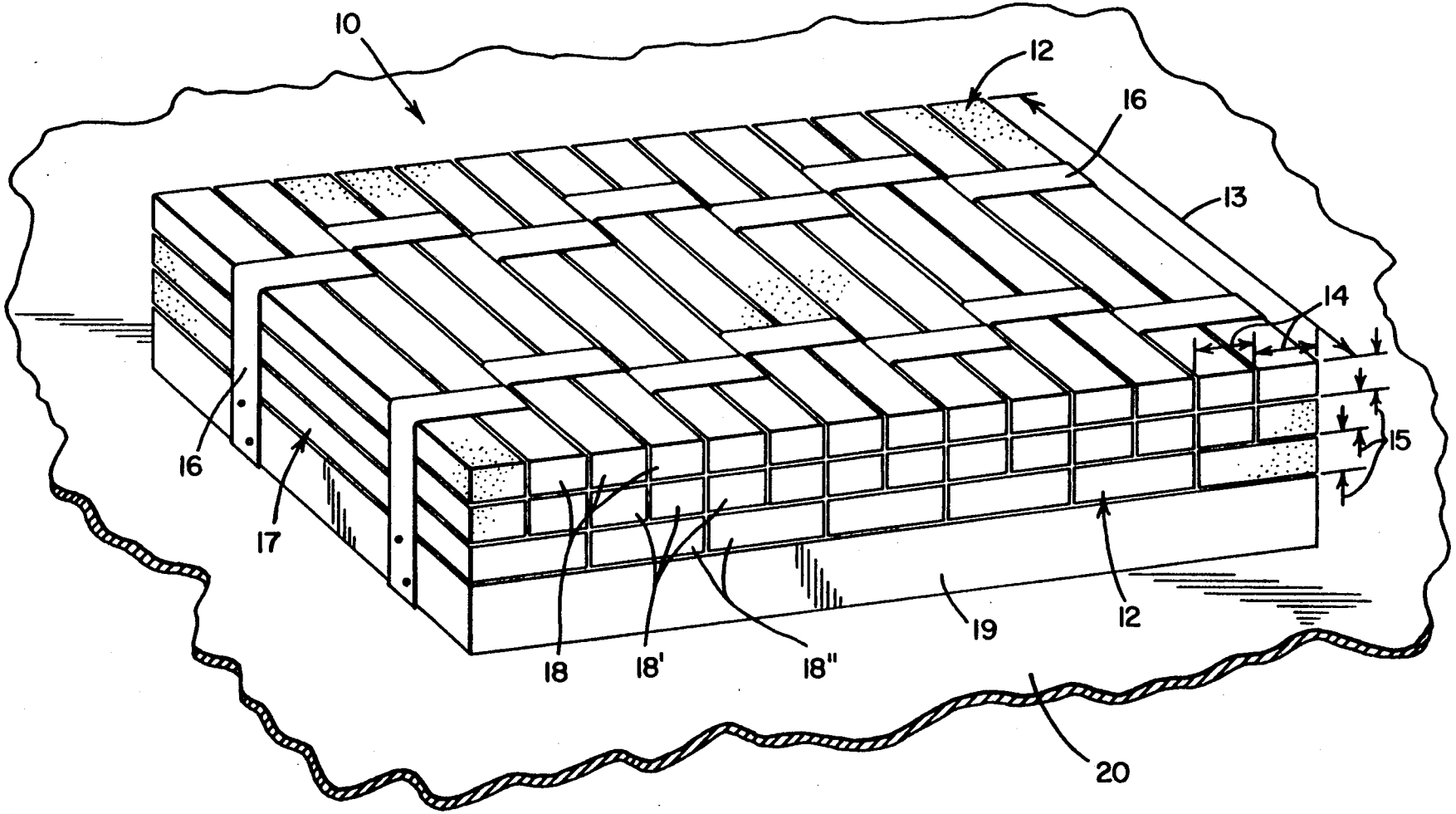
FIG. 1 is a perspective depiction of a reflector made in accordance with the invention.

Referring to the drawings, FIG. 1 is a perspective embodiment of a reflector 10 made in accordance with the invention. The reflector 10 includes a plurality of individual box-like structures 12. The box-like structures 12 are possessed of a length 13 substantially in excess of width 14 and height 15.

Straps 16 function to hold together bundles 17 of the box-like structures 12. The bundles 17 each contain box-like structures 12 with the box-like structures 12 each being a part of a separate rank 18, 18', 18'' of generally coplanar box-like structures having lengths 13 oriented substantially co-parallelly. From one rank 18, 18', 18'' to the next, the width 14 and/or thickness 15 of individual box-like structures within the ranks may vary.

A backplate 19 is employed in FIG. 1 to which the stacks 17 of box-like structures 12 are fixed. The backplate 19 can be formed of any suitable or conventional material such as rubber, steel or the like and is affixed to an outer hull, shown generally at 20, of a vessel such as a submarine or other deep water submersible. Affixation of the backplate 19 to the hull 20 can be accomplished in appropriate, well-known manner such as by welding, riveting, attachment employing clips, and the like.

Figures 2, 3, 4:
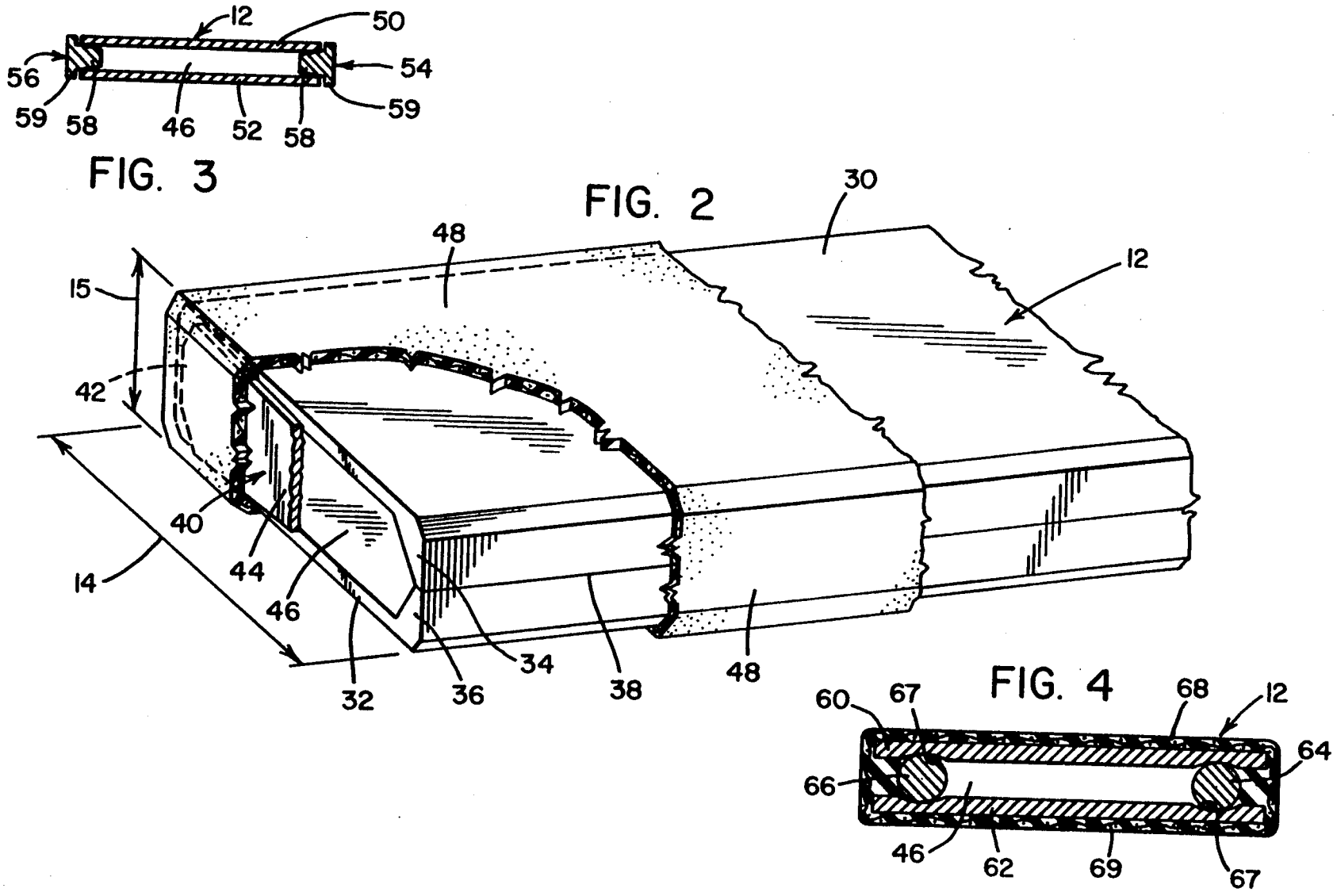
FIG. 2 is a perspective representation in partial section of a box-like structure made in accordance with the invention.
FIG. 3 is a cross-sectional representation of an alternate embodiment of a box-like structure made in accordance with the invention.
FIG. 4 is a section view of a still further alternate embodiment of a box-like section made in accordance with the invention.

Referring to the drawings, FIG. 2 depicts one preferred embodiment of a box-like structure 12 suitable for use in the sonic reflector 10. In FIG. 2, the box-like structure 12 includes a height 15 and a width 14. A length dimension 13 is defined by a pair generally parallel plate-like elements 30, 32. Edge portions 34, 36 of each plate-like element 30, 32 are deformed generally one towards the other by bending or the like to define an engagement zone 38 where the edge portions 34, 36 meet. The engagement zone 38 represents an intersection between the edges Portions 34, 36. The edge portions 34, 36 function to support the plate-like elements 32, 30 in a spaced apart relationship.

An end closure 40 functions to close ends of the box-like structure 12. In preferred embodiments the end closure 40 is configured to be of a greater width at end portions 42 thereof in contrast to central portions 44 thereof. This difference in width functions to provide an accommodation for bending motion of the plate-like elements 30, 32 one towards the next primarily at center portions thereof while the box-like structure 12 is subjected to hydrostatic pressures impinging thereon by reason of a reflector 10 embodying the box-like structure 12 being operated at significant depth in a marine environment. The end closure 40, or so-called "dog bone" by reason of its particular width profile thereby functions to close effectively the end of the box-like structure 12. A similar dog bone is positioned at a remaining end of the box-like structure (not shown in FIG. 2).

It may be desirable to include a similarly shaped dog bone structure (not shown) formed of a plastic such as nylon between the dog bone 40 and the plates 30, 32 to assure against noise as the plates move relative to the dog bone 40.

An elastomeric encapsulant 48 surrounds the box-like structure 12. The encapsulant 48 can be of any suitable or conventional nature but in one preferred embodiment includes at least one fabric ply formed of a fabric coated on one or both surfaces with a plasticizing or rubberizing compound and one or more elastomeric or rubber plies attached thereto. Typically the elastomeric encapsulant 48 will consist of one or more plies of a rubberized fabric such as nylon fabric grade 80 available from the B.F. Goodrich Company having vulcanizably bonded thereto on one surface a sheet ply of rubber and vulcanizably bonded thereto on an outer surface a sheet ply of a rubber containing therein a biologically active substance. Nofoul® rubber available from the B.F. Goodrich Company can be employed as the biologically active substance containing ply. The biological activity of the outer rubber ply functions to retard the accumulation of marine deposits such as barnacles and other dysfunctional marine growth upon the elastomeric encapsulant 48. Since following vulcanization or curing the plies forming the elastomeric encapsulant 48 become substantially inseparable, the individual plies are not depicted in the Figures. Making of elastomeric fabric reinforced materials suitable for use as encapsulants are well-known in the art.

It is important that the elastomeric encapsulant 48 encapsulate the box-like structure completely thereby preventing the movement of liquids such as seawater from points external to the box-like structure 12 to a central cavity 46 defined by the plate-like elements 30, 32 of the box-like structure 12 and the dog bones 40. It is this central cavity 46 that, in significant measure, provides desirable sonic reflection or sonic barrier characteristics to a plurality of the box-like structures 12 when arranged in an array or reflector 10 as shown in FIG. 1. It may be seen that the dog bone or variable width configuration of the end closures 40 depicted in FIG. 2 functions to reduce tearing stresses and deformation imposed on the elastomeric encapsulant 48 as the plate-like elements 30, 32 deform one towards the next by bending when subjected to hydrostatic pressure.

Selection of particular rubber or other elastomeric materials in forming the elastomeric encapsulant 48 is complicated by certain static and dynamic properties inherent in individual rubber or other elastomer Compounds that may be selected in forming the elastomeric encapsulant 48. These rubber compounds may be possessed of static or dynamic properties which can enhance or detract from the performance of a reflector 10 as formed from box-like structures 12, each having a surrounding elastomeric encapsulant 48. While the general performance characteristics of many rubbers is familiar to those skilled in the art of forming sonic reflectors, the particular synergism achieved between the elastomeric encapsulant 4, the plate-like elements 30, 32 by virtue of their width and thickness, and the chamber or cavity 46 in reflecting acoustic signals will be, in part, a function of experimentation to define what width and thickness of the plate-like elements 30, 32, what cavity size 46, and what elastomeric encapsulant 48 materials of construction function to produce a desired reflecting or barrier effect at particular sonic frequencies it is desired be reflected or barred.

Referring again to FIG. 2, the end closure 40 typically is not affixed to the plate-like elements 30, 32. The unattached end closure 40 can thereby readily accommodate positional changes necessary to react to bending or shifting movement of the plate-like elements 30, 32 in response to hydraulic loadings imposed thereon and changes in overall dimensional configuration of the box-like elements 12 associated with changes in temperature and other environmental factors impacting upon the box-like elements 12 forming a reflector 10.

The box-like element 12 as depicted in FIG. 2 differs from more conventional squashed-tube configurations, in that the plate-like elements 30, 32 present a nearly parallel plane interface with the marine environment in which the reflector 10 is operated, thereby facilitating a calculation of the proper configuration and sizing of the elements 30, 32, 48, 46 of the box-like elements 12 to intercept particular, desired sonic frequencies. The end closure 40 provides a desirable alternate to a traditional pinch-type closure characterizing or typifying squashed-tubes employed for reflectors. The end closure of Applicant's invention provides for a reduced zone of stress on the elastomeric encapsulant 48 at end Portions of the box-like structures 12 made in accordance with the invention.

Turning to FIG. 3, an alternate preferred embodiment of the box-like structure 12 is depicted wherein a pair of generally parallel, plate-like elements 50, 52 are separated by T-blocks 54, 56. The T-blocks include a spacer portion 58 and ears 59. The ears 59 function to suppress a tendency for the plate-like elements 50, 52 to shift laterally in parallel planes one with respect to the other while the spacer portions 58, unattached to the plates, function to separate the plate-like elements 50, 52 to a desired extent establishing the parallel planar relationship therebetween. Naturally, the separation of the plates 50, 52 and thereby impart the volume parameters of the cavity 46 can be determined in substantial part by the selection of the dimensions of the spacer portion 58 of the T-blocks 54, 56, subject of course to deformation effects attributable to the effects of hydrostatic pressure upon the plate-like elements 50, 52. The cavity 46 associated with the box-like structure 12 as depicted in FIG. 3 can thereby be defined as a function of a width dimension of the plate-like elements 50, 52, a longitudinal dimension of the plate-like elements 50, 52 and the spacing between the plate-like elements defined by the spacer block 58. This cavity 46 is possessed of a volume that changes with distortional bending of the plate-like elements 50, 52 under hydrostatic forces.

In contrast to a squashed-tube configuration, the plate-like elements 50, 52 of the box-like structure as depicted in FIG. 3 define a more ideal parallel plate configuration facilitating modeling of some performance of an array of the structures 12 employing more simplistic calculation of the sonic frequency reflecting/-barring capabilities for a particular embodiment of a box-like structure 12 made in accordance with FIG. 3. Naturally, an elastomeric encapsulant (not shown in FIG. 3 for clarity) surrounds the T-blocks 54, 56 and the plate-like elements 50, 52. As in the embodiment of FIG. 2, a pair of end closures (not shown in FIG. 3 for clarity) can be employed in the manner depicted in FIG. 2 to close the ends of the box-like structure 12 as depicted in FIG. 3. Any such end closures 40 preferably embody a "dog bone" configuration facilitating accommodation of bending movement engendered in the plate-like elements 50, 52 by dint of hydrostatic pressure encountered by operation of the box-like structures 12 between marine environments of varying depths.

Any elastomeric encapsulant employed in box-like structures 12 as depicted at FIG. 3 is subject to the same selection criteria as would apply to the elastomeric encapsulant for the box-like structures 12 depicted in FIG. 2.

Turning to FIG. 4, a still further preferred embodiment of the invention is shown wherein a pair of plate-like elements 60, 62 are positioned in a generally parallel relationship. The plate-like elements 60, 62 are separated by a pair of rod elements 64, 66. Each rod element 64, 66 presents a generally curvilinear bearing surface to the plate-like elements 60, 62 as would be inherent in a rod-like structure having a curvilinear exterior surface. It should be noted that the rod-like elements 64, 66 could equally be rods having a rectilinear cross-section such as quadrangles, hexangles, or octangles, without limitation, and such rectilinear cross-sections for purposes of this specification shall be deemed also to present a bearing surface which, for Purposes of the embodiment depicted in FIG. 4, and shall therefor be deemed to be "curvilinear".

Channels 67 are formed in the plate-like elements 60, 62 with the channels 67 being configured to receive curvilinear bearing surfaces associated with the rods 64, 66. An elastomeric encapsulant 68 including a fabric reinforced subply 69 therein encapsulates the box-like structure 12 of FIG. 4 in a manner similar to the function of the elastomeric encapsulant 48 in FIG. 2. In FIG. 4, the channel 67 function to assist the elastomeric encapsulant 68 in retarding lateral shifting of the plate-like elements 60, 62 within the plane occupied by each, under the stresses and strains of operation in deep water marine environment.

In the embodiment of FIG. 4, it is contemplated that end closures (not shown in FIG. 4 for clarity) similar to the end closures 40 shown and depicted in FIG. 2 may be employed to close the ends of the box-like structures 12 of FIG. 4. Any such end closures Preferably are of a "dog bone" configuration that is wider at ends thereof than towards the center thereof to accommodate more readily distortional bending of the p late-like elements 60, 62 under the duress imposed by hydrostatic forces encountered by operation of the box-like structures 12 of FIG. 4 at varying depths in a marine environment.

It should be noted that the rods 64, 66 need not be continuous for a full length of the plate-like elements 60, 62. The rods 64, 66 may instead be rod segments presenting the necessary curvilinear bearing surface and positioned as required generally end-to-head to establish support for the plate-like elements 60, 62 along a length of the channels 67. Alternately, the rods 64, 66 may instead be balls presenting a curvilinear support surface. The channels 67 may include sufficient of any such balls to provide an effectively continuous support for the plate-like members 60, 62.

It may be seen from FIGS. 3–4 that the box-like structures 12 of the invention present a virtually uniform flat-plate configuration facilitating more simplistic prediction of the baffling or reflecting performance of arrays 10 of the box-like structures 12 to impinging sonic frequencies.

In preferred embodiments of the invention as set forth herein the elastomeric encapsulants 48, 68 as depicted in FIGS. 2 and 4 typically include a core ply designated at reference numeral 69 in FIG. 4 formed from a fabric reinforced elastomer or so-called coated fabric. By fabric what is meant is knit, woven, cord, wire, cable or chopped fiber reinforcement formed from suitable or conventional natural or synthetic fibrils such as steel, polyester, polyaramide, polyimide and the like resistant to the effects of and acceptable for use in a marine environment. These fibrils may, optionally, have been spun and/or otherwise formed into bundles of fibrils for purposes of providing reinforcing cords, mesh, knit, or other fabric materials. If chopped, the chopped fiber can either be chopped monofilaments or fibrils or may be a chopped fiber derived from chopping spun or otherwise bundled fibrils.

The elastomers used in forming the core ply 69 can be of any suitable or conventional nature and may include natural rubber, synthetic rubbers such as chlorinated (NEOPRENE ® available from duPont), silicone, and similar rubbers, or may be polybutadiene, acrylonitrile, butadiene co-polymer, or styrene-butadiene rubbers. The particular selection of coated fabric and elastomer employed in fabricating the core ply 69 will be at least in part a function of the destructive forces to which the elastomeric encapsulant 68 will be subjected in the marine environment, the temperature and acoustic conditions under which the elastomeric encapsulant 48, 68 is to be employed, and the degree of elasticity and acoustic hydrodynamic properties it is desired the elastomeric encapsulant 48, 68 demonstrate upon exposure to hydrostatic forces applied thereto. The fabrication of coated fabric such as fabric reinforced rubberized sheeting is well-known and conventional well-known techniques may be employed for fabricating the elastomeric encapsulant 48, 68.

Alternately, the elastomeric encapsulant 48, 68 can be formed from castable liquid polymers. The formation of structures from castable liquid polymers is known in the art. Criteria controlling the selection of a particular castable elastomer will be similar to those governing the selection of other elastomers as set forth herein. Examples of suitable castable liquid polymers would include polyurethanes, Hycar ® reactive liquid polymers (BFGoodrich) and silicones.

The elastomeric encapsulant 48, 68 may include a filling agent in any rubber or other elastomeric compounding materials. This filling agent, which may be present in a quantity of between 0 and about 80 parts per hundred weight of the rubber or other elastomer forming the elastomeric encapsulant 48, 68 and, generally is present in a quantity of between 0 and 40 parts per hundred weight of the rubber or other elastomer forming the elastomeric encapsulant 48, 68 and may be a particulate such as carbon black, glass microspheres, or microbeads, or may be a fiber-like additive (in addition to any used in a core ply 69 as shown in FIG. 4) such as mineral, polyester, polyolefin, polyaramide, polyamides, polyimides, polyvinyls, such as polyvinyl alcohol (e.g. 1 millimeter × 6 denier). The extent to which fillers are employed in fabricating the elastomeric encapsulant 48, 68 is at least in part a function of the dynamic, acoustic hydrodynamic properties such as longitudinal propagation, attenuation and loss tangent characteristics desired for those acoustic wave forms anticipated as impacting the reflector 10 and by any dynamic modulus, static modulus and Young's modulus properties it is desired be achieved in any resulting elastomeric encapsulant 48, 68. "Elastomeric" or "elastomer" as used in connection with this invention shall mean a material possessed of an ability to recover, at least in significant part, a former shape or configuration upon removal of a configuration or shape distorting force. By "rubber" as used in connection with this invention what is meant is a vulcanized, or otherwise cross-linked elastomer made according to conventional, well-known techniques.

In forming the elastomeric encapsulant 48, 68, it is preferred that the elastomeric encapsulant 48, 68 be possessed of: a static tensile modulus of between about 200 psi (1380 kPa) to about 2000 (13,800 kPa) psi; a Young's modulus of between about 200 psi (1380 kPa) and about 2000 psi (13,800 kPa); a density of between about 1.0 and about 1.5 grams/cc $^3$; loss tangent properties of between about 0.05 and about 0.40 (units); dynamic shear modulus (dynes/cm$^2$) properties of $10^7$; and a static shear modulus property of between about 65 psi (442 kPa), and about 700 psi (4825 kPa).

By the term Young's modulus what is meant is a ratio of the simple tension stress applied to a material to the resulting strain parallel to the tension. The Young's modulus is also a measure of the modulus elasticity for the material, which modulus of elasticity may also be known as a co-efficient of elasticity, the elasticity modulus, or the elastic modulus. By the term tensile modulus what is meant is a tangent or secant modulus of elasticity of a material in tension. By density what is meant is weight/unit volume. By loss tangent what is meant is a ratio of the viscous modulus to the elastic modulus for a Particular material. By viscous modulus what is meant is that modulus proportional to a deforming force not recovered or conserved. The viscous modulus typically is observed only under dynamic stress. By elastic modulus what is meant is a ratio of an increment of some specified form of resulting stress to the increment of some specified form of strain which may also be known as the co-efficient of elasticity. The elastic and viscous modulus are also herein referred to as dynamic modulus or moduli.

Referring again to FIG. 4, one source of noise in the operation of reflectors 10 comprising box-like structures 12 is what is known as stick/slip noise engendered at metal-to-metal contact surfaces between, for example, the curvilinear bearing surfaces of rods 64, 66 and the plate-like elements 60, 62. The particularly curvilinear bearing surfaces of rods or balls (as distinguished from more rectilinear surface configurations such as are shown in FIG. 2) as employed in the Preferred embodiment depicted in FIG. 4 tends to establish point or point-like contact between the plate 60, 62 and the rods 64, 66 which, it is believed, substantially reduces acoustic noise generated by stick/slip at the metal contact surfaces as the plates 60, 62 conform to changing hydrostatic conditions. Likewise, in the embodiment of FIG. 3, it is believed that as hydrostatic pressure increases on the plates 50, 52, point contact develops with respect to the spacer portion 58 thereby establishing a limited zone for stick/slip acoustic noise generation.

Particularly, the embodiment of FIGS. 2, 3 and 4 offer a substantial opportunity for improved stick/slip performance with respect to configurations such as are shown in the purely theoretical depiction of Junger, *J. Accoust. Soc. Am.* 78(3), 9/65 pp 1010. One possible explanation is that these embodiments more closely resemble a simply supported beam in contrast to clamped beams of Junger. This simply supported beam construction appears to result in a lower inherent resonant frequency. For example, for beams, that is parallel plates 30, 32, 50, 52, 60, 62, of equal length and mass/unit length, and formed of the same material a ratio of $\Omega_n$ for the simply supported beams of the invention to $\Omega_n$ for the clamped beams of Junger at the lowest frequency, approaches 0.50; $\Omega_n$ being calculated from the operation $$\Omega_n = a_n \sqrt{EI/\mu l^4}$$

where l is the beam length, $\mu$ its mass/unit length, EI the bending stiffness, and $a_n$ a numerical co-efficient associated with particular boundary conditions for the beam at a specific frequency.

The plate-like elements 30, 32, 50, 52, 60, 62 can be made of any suitable or conventional material, but typically are made from a metal such as steel or stainless steel; substantial resistance to bending forces imposed by hydrostatic pressure is desirable in these plate-like element together with a freedom from metal fatigue tendencies that would be deleterious to performance of the box-like structure 12 under the frequent flexing of the plate-like elements 30, 32, 50, 52, 60, 62 engendered by in hydrostatic pressure changes as a result of operation of a submarine or the like embodying a box-like structure 12 in accordance with the invention at varying depths in a marine environment. The plate-like elements 30, 32, 50, 52, 60, 62 can also be made of plastic or reinforced plastic materials such as fiberglass reinforced phenolics or epoxys and polyester reinforced epoxys or Phenolics. The materials forming the plate-like elements 30, 32, 50, 52, 60, 62 must withstand bending forces and be possessed of a substantial capability for recovery from bending engendered by hydrostatic forces encountered in service. Depending on the particular configuration of a box-like structure 12, the selection of a particular material of construction for the plate-like elements 30, 32, 50, 52, 60, 62 will be a matter of some experimentation to optimize both structural and acoustic properties of the box-like structure 12.

The T-bars 54, 56 and the rods 64, 66 presenting curvilinear bearing surfaces can be formed of any suitable or conventional materials such as steel or stainless steel but, for weight considerations may also be formed of lightweight metals and metal alloys such as titanium, aluminum or other suitable or conventional, metal alloy materials. The T-bars 54, 56 and rods 64, 66 can also be formed of plastic materials in accordance with the material criteria set forth for the plate-like elements 30, 32, 50, 52, 60, 62 or such other plastic materials or reinforced plastic materials as are capable of accepting the crushing forces associated with loadings imposed by the plate-like elements by reason of hydrostatic loading thereupon. The rods 64, 66 typically are formed simply of hardened steel drill rod as such drill rod is readily commercially available in precision diameters.

While a preferred embodiment of the invention has been shown and described in detail, it should be apparent that various modifications may be made thereto without departing from the scope of the claims that follow:

What is claimed is:

1. A sonic reflector, configured for use in a marine environment, comprising:

a plurality of discrete rectangular hollow box-like structures each formed of at last two discrete longitudinal plate-like mechanical elements supported only along their lengthwise edges and an unattached closure plate at each end thereof which does not support the ends of the longitudinal elements, the plate-like longitudinal elements being free to move by bending motion along the entire length thereof, each box-like structure having a length substantially in excess of a width and thickness thereof;

the box-like structures being arranged generally in at least one rank, box-like structures at least within a particular rank having essentially equal lengths oriented substantially parallelly; and means for providing imperviousness to water penetration comprising an elastomeric encapsulant surroundingly encapsulating the box-like structures individually.

2. The reflector of claim 1 wherein at least one end closure plate is configured to be of greater width at its end portions than at its central portion.

3. The reflector of claim 1, wherein the at least two discrete longitudinal mechanical elements comprise a pairs of plate-like elements configured in generally parallel plane relationship and spaced apart one to the next, the box-like structures further comprising a pair of non-elastomeric spacers configured to support and separate the plate-like elements along only their lengthwise edges, the spacers being configured in the form of T-blocks.

4. The reflector of claim 1, wherein the at least two discrete longitudinal mechanical elements comprise a pair of plate-like elements configured in generally parallel plane relationship and spaced apart from each other, and a pair of rigid spacers configured to support and separate the plate-like elements, the spacers being configured in the form of structures having curvilinear bearing surfaces, the spacers being selected from at least one of rods, and balls, and the parallel plate-like elements including channels formed therein configured for receiving the curvilinear bearing surface structures.

5. The reflector of claim 2, wherein the at least two discrete longitudinal mechanical elements comprise a pair of plate-like elements configured in generally parallel plane relationship and spaced apart from each other, and a pair of rigid spacers configured to support and separate the plate-like elements, the spacers being configured in the form of structures having curvilinear bearing surfaces.

6. The reflector of claim 2, wherein the at least two discrete longitudinal mechanical elements comprise a pair of plate-like elements configured in generally parallel plane relationship and spaced apart one to the next, the box-like structures further comprising a pair of non-elastomeric spacers configured to support and separate the plate-like elements along their lengthwise edges, the spacers being configured in the form of T-blocks having tapered bearing surfaces.

7. A sonic reflector, configured for use in a marine environment, comprising:

a plurality of discrete hollow box-like structures, each box-like structure having a length substantially in excess of a width and thickness thereof;

the box-like structures generally being arranged in at least one rank, box-like structures at least within a particular rank having substantially equal lengths thereof oriented substantially parallelly;

the box-like structures each being formed of a pair of discrete, longitudinal rectangular mechanical plate-like elements configured to lie in a generally parallel plane relationship and spaced apart one from the next a predetermined amount, and a pair of spacers configured to support and establish the plate-like elements only along their lengthwise edges in spaced apart manner, the spacers being configured in the form of rigid structures having curvilinear bearing surfaces and selected from at least one of rods, and balls, the parallel plate-like elements including channels formed therein and complementarily configured for receiving the structures having curvilinear bearing surfaces; and means for providing imperviousness to water penetration comprising an elastomeric encapsulant surroundingly encapsulating the box-like structures individually.

8. The reflector of claim 7, including an end closure plate at each end of each of the box-like structures and encapsulated within the elastomeric encapsulant, each end closure plate being unattached to the longitudinal plate-like elements, the longitudinal plate-like elements forming each pair being free to move by bending motion toward and away from one another along their entire length.

9. The reflector of one of claim 7 or 8, the spacer being a rod.

10. A sonic reflector, configured for use in a marine environment, comprising:

a plurality of hollow box-like structures, each box-like structure having a length substantially in excess of a width and thickness thereof;

the box-like structures being arranged generally in at least one rank, box-like structures at least within a particular rank having substantially equal lengths thereof oriented substantially parallelly;

the box-like structures each being formed of a pair of discrete longitudinal rectangular plate-like elements having a length substantially in excess of the width and thickness thereof, the pair of plate-like elements configured in a generally parallel plane relationship spaced apart one from the next predetermined amount, and a pair of spacers configured to separate and rigidly support the lengthwise edges but no the widthwise edges of the plate-like elements of each box-like structure in spaced apart relationship, the pair of spacers being positioned along the length of the plate-like elements, but not across the width thereof, the plate-like elements being unsupported at the ends thereof, the spacers being configured in the form of T-blocks; and means for providing imperviousness to water penetration comprising an elastomeric encapsulant surrounding encapsulating the box-like structures individually.

11. The reflector of claim 10, including an end closure plate at each end of each of the box-like structures and encapsulated within the elastomeric encapsulant, each end closure plate being unattached to the longitudinal plate-like elements, the longitudinal plate-like elements forming each pair being free to move by bending motion toward and away from one another along their entire length.

12. The reflector of claim 10, the reflector being configured for mounting to an outer surface of a deep water submersible and further configured to reflect acoustic frequencies emanating from within the submersible.

13. The reflector of claim 11, the reflector being configured for mounting to an outer surface of a deep water submersible and further configured to reflect acoustic frequencies emanating from within the submersible.

14. A sonic reflector, configured for use in a marine environment, comprising:

a plurality of discrete rectangular hollow box-like structures, each box-like structure having a length substantially in excess of a width and thickness thereof;

the box-like structures generally being arranged in at least one rank, box-like structures at least within a particular rank having substantially equal lengths thereof oriented substantially parallelly;

the box-like structures being each formed in part by a pair of discrete longitudinal rectangular mechanical plate-like elements configured in a generally parallel plane relationship, the elements of each pair being spaced apart one from the next, each of the plate-like elements of a pair forming a particular box-like structure having longitudinal edge portions thereof bent in a direction generally towards the other plate-like element of the pair whereby longitudinal edge portions of the parallel plate-like elements in a pair are configured to establish and support the plate-like elements of the pair in predetermined spaced apart manner by engagement of only their respective corresponding longitudinal edge portions; and means for providing imperviousness to water penetration comprising an elastomeric encapsulant surroundingly encapsulating the box-like structures individually.

15. The reflector of claim 14, including an unattached end closure plate within the means for providing imperviousness to water penetration at each end of each of the box-like structures which end closure plates do not support the longitudinal plate-like elements which are free to move by bending motion toward and away form one another along their entire length.

16. The reflector of claim 15, the reflector being configured for mounting to an outer surface of a deep water submersible and further configured to reflect acoustic frequencies emanating from within the submersible.

17. The reflector of claim 14 the reflector being configured for mounting to an outer surface of a deep water submersible and further configured to reflect acoustic frequencies emanating from within the submersible.

18. A rectangular box-like structure suitable for use in a sonic reflector, configured for submersion into deep waters of a marine environment, comprising:

a pair of plate-like elements positioned in a generally parallel plane relationship and spaced apart one to the other a predetermined amount; the plate-like elements being of corresponding length substantially in excess of the width and thickness thereof;

means for supporting the lengthwise edges but not the widthwise edges of the plate-like elements in generally parallel plane relationship and spaced apart one to the other a predetermined amount;

an unattached end closure plate at each end of the pair of plate-like elements; and means for providing imperviousness to water penetration comprising an elastomeric encapsulant surroundingly encapsulating the box-like structure individually.

19. The box-like structure of claim 18, further including a pair of rigid spacers configured to support and separate the plate-like elements in predetermined amount, the spacers being configured in the form of structures having curvilinear bearing surfaces.

20. The box-like structure of claim 18, each of the pair of plate-like elements including lengthwise edge portions formed and oriented in a direction generally towards the other element of the pair of plate-like elements, the lengthwise edge portions of one element of the pair being configured to engage the lengthwise edge portions of the other element of the pair and configured to thereby establish and support the plate-like elements in predetermined spaced apart relationship.

21. The box-like structure of claim 18, further including a pair of non-elastomeric spacers configured to support and separate the plate-like elements in predetermined amount, the spacers being configured in the form of T-blocks, the spacers being positioned so as to extend only along the lengthwise edges of the plate-like elements.

22. The box-like structure of claim 21, the spacers having rigid curvilinear bearing surfaces and being selected from at least one of rods, and balls.

23. The box-like structure of claim 22, the spacers having curvilinear bearing surfaces and being rods, and the parallel plate elements including a pair of channels formed therein complementarily configured to receive the rods.

* * * * *